US006745691B1

(12) United States Patent
Huang

(10) Patent No.: US 6,745,691 B1
(45) Date of Patent: Jun. 8, 2004

(54) INK SUPPLYING DEVICE FOR TAPE DISPENSER HAVING A PRINTING WHEEL

(76) Inventor: Harrison Huang, No. 23, Lin T'So Rd. Sheng Kang Hsian, Taichung Hsien (TW)

( * ) Notice: Subject to any disclaimer, the term of this patent is extended or adjusted under 35 U.S.C. 154(b) by 0 days.

(21) Appl. No.: 10/301,604

(22) Filed: Nov. 22, 2002

(51) Int. Cl.[7] ..... B41F 31/00
(52) U.S. Cl. ..... 101/335; 101/336
(58) Field of Search ..... 101/330, 333, 101/335, 336, 328, 35, 126, 422

(56) References Cited

U.S. PATENT DOCUMENTS 2,299,242 A * 10/1942 Lui ..... 101/328
3,654,863 A * 4/1972 Hill et al. ..... 101/335
3,662,682 A * 5/1972 Marozzi ..... 101/219
3,901,148 A * 8/1975 Clark ..... 101/228
4,023,490 A * 5/1977 Marozzi ..... 101/235
4,145,967 A * 3/1979 Marozzi ..... 101/333
4,566,387 A * 1/1986 Marozzi ..... 101/330
4,580,495 A * 4/1986 Scrudato ..... 101/330
4,656,939 A * 4/1987 Lasauskas et al. ..... 101/35
5,086,697 A * 2/1992 Koper et al. ..... 101/336
5,219,160 A * 6/1993 Kemp ..... 101/422
5,894,794 A * 4/1999 Imamaki et al. ..... 101/125

* cited by examiner

*Primary Examiner*—Eugene H. Eickholt
(74) *Attorney, Agent, or Firm*—Bacon & Thomas, PLLC

(57) ABSTRACT

An ink supplying device for tape dispenser is disclosed to include a housing detachably mounted in the tape dispenser for receiving ink therein, a porous ink soaking layer mounted inside the housing and adapted to soak ink, and a fabric ink applying layer covered on the porous ink soaking layer and adapted to be contacted with the printing surface of a printing wheel of the tape dispenser for applying ink from the porous ink soaking layer to the printing surface of the printing wheel evenly.

4 Claims, 2 Drawing Sheets

INK SUPPLYING DEVICE FOR TAPE DISPENSER HAVING A PRINTING WHEEL

BACKGROUND OF THE INVENTION

1. Field of the Invention

The present invention relates to tape dispensers and, more specifically, to an ink supplying device for use in a tape dispenser to apply ink to the printing surface of a printing wheel of the tape dispenser when the printing wheel rotated upon operation of the tape dispenser.

2. Description of the Related Art

U.S. Pat. Nos. 5,947,025 and 6,112,659 respectively disclose a tape dispenser capable of printing patterns and words on the tape dispensed thereby and an adhesive tape dispenser provided with means for printing adhesive tape being dispensed. According to these two US patents, the tape dispenser comprises an ink supplying device (referenced by 50 in either patent) that supplies ink to the printing plate of the printing wheel. The ink supplying device comprises an ink storage cassette (referenced by 55 in U.S. Pat. No. 5,947,025, or 51 in U.S. Pat. No. 6,112,659), and a roller-like ink soaking member (referenced by 56 in U.S. Pat. No. 5,947,025, or 53 in U.S. Pat. No. 6,112,659) made of sponge and fastened rotatably with the ink storage cassette. The roller-like ink soaking member soaks up ink from the ink storage cassette, and keeps the periphery in close contact with the printing plate of the printing wheel. When the printing wheel rotated by the tape being dispensed, the roller-like ink soaking member is rotated to apply ink to the printing surface of the printing plate of the printing wheel, thereby causing the printing wheel to print patterns and words on the underside of the tape being dispensed.

The aforesaid ink supplying device is still not satisfactory in function. When the roller-like ink soaking member soaked up ink in the saturated status, excessive amount of ink may be applied to the periphery of the printing wheel, resulting in poor printing quality. Further, because the roller-like ink soaking member cannot keep ink wet for long, ink soaked up by the roller-like ink soaking member easily changes into vapor, resulting in unclear or thin printing on the tape being dispensed. In general, the use of the aforesaid ink supplying device makes printing quality control difficult.

SUMMARY OF THE INVENTION

The present invention has been accomplished to provide an ink supplying device for tape dispenser, which eliminates the aforesaid drawbacks. It is therefore the main object of the present invention to provide an ink supplying device for tape dispenser, which applies ink to the printing surface of the printing wheel evenly to achieve a high quality printing effect.

It is another object of the present invention to provide an ink supplying device for tape dispenser, which keeps ink from changing into vapor.

To achieve these objects of the present invention, the ink supplying device comprises a housing detachably mounted in a tape dispenser for receiving ink therein, a porous ink soaking layer mounted inside the housing and adapted to soak ink, and a fabric ink applying layer covered on the porous ink soaking layer and adapted to be contacted with the printing surface of a printing wheel of the tape dispenser for applying ink from the porous ink soaking layer to the printing surface of the printing wheel evenly.

DETAILED DESCRIPTION OF THE PREFERRED EMBODIMENT

Figure 1:
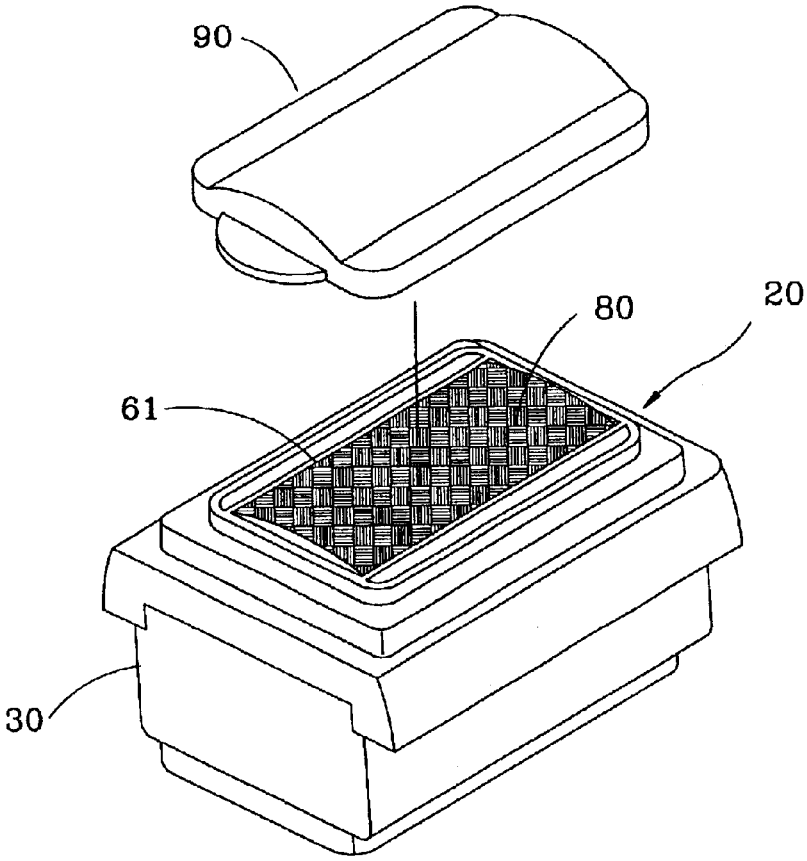
FIG. 1 is an exploded view of an ink supplying device for tape dispenser according to the present invention.
Figure 2:
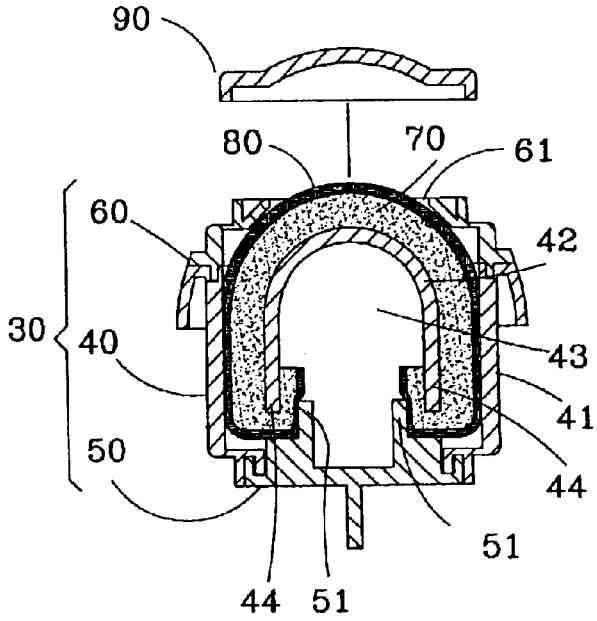
FIG. 2 is a cross sectional view of the ink supplying device shown in FIG. 1.

Referring to FIGS. 1 and 2, an ink supplying device 20 in accordance with the present invention is shown comprised of a housing 30, a porous ink soaking layer 70, and a fabric ink applying layer 80.

The housing 30 is a substantially rectangular shell comprised of a main body 40, a bottom member 50, and a top member 60. The main body 40, the bottom member 50, and the top member 60 are respectively injection-molded from plastics. The main body 40 comprises a hollow rectangular outer shell 41 shaped like a rectangular box having a top open side and a bottom open side, a round arch-like inner shell 42 integral with the outer shell 41, the round arch-like inner shell 42 having two opposite sidewalls 44 equally spaced from the two opposite lateral sides of the outer shell 41 at a distance, and an inside chamber 43 defined within the round arch-like inner shell 42. The bottom member 50 is a rectangular plate member sealed to the bottom side of the main body 40, comprising two upright clamping strips 51 inserted into the inside chamber 43 and maintained in parallel to the two opposite sidewalls 44 of the main body 40. The top member 60 is a stepped hollow cover member sealed to the top side of the main body 40, having a center opening 61 smaller than the top open side of the main body 40. Thus, the main body 40, the bottom member 50, and the top member 60 form the housing 30 having the opening 61 in the top side.

The porous ink soaking layer 70 is piece of absorptive non-woven fabrics (for example, felt) mounted within the housing 30 and closely covered on the round arch-like inner shell 42, keeping the two distal ends thereof fixed to the bottom side of the housing 30 (this will be described latter).

The fabric ink applying layer 80 is a piece of velvet closely attached to the outer surface of the ink soaking layer 70, keeping the two distal ends thereof fixed to the bottom side of the housing 30. The center area (the top area) of the fabric ink applying layer 80 protrudes through the opening 61 over the top side of the housing 30.

During assembly process of the ink supplying device 20, the fabric ink applying layer 80 and the ink soaking layer 70 are arranged in a stack and then covered the round arch-like inner shell 42 inside the main body 40, keeping the two opposite ends of the stack of the fabric ink applying layer 80 and ink soaking layer 70 extended over the bottom side of the round arch-like inner shell 42 into the inside of the inside chamber 43, and then the bottom member 50 is closed on the bottom side of the main body 40 to force the clamping strips 51 into the inside of the inside chamber 43, for enabling the two opposite ends of the stack of the fabric ink applying layer 80 and ink soaking layer 70 to be clamped in between the sidewalls 44 of the round arch-like inner shell 42 and the two clamping strips 51 of the bottom member 50, and at last, the top member 60 is capped onto the top side of the main body 40 to hold down the stack of the fabric ink applying layer 80 and ink soaking layer 70 on the round-like inner shell 42 within the housing 30.

Figure 3:
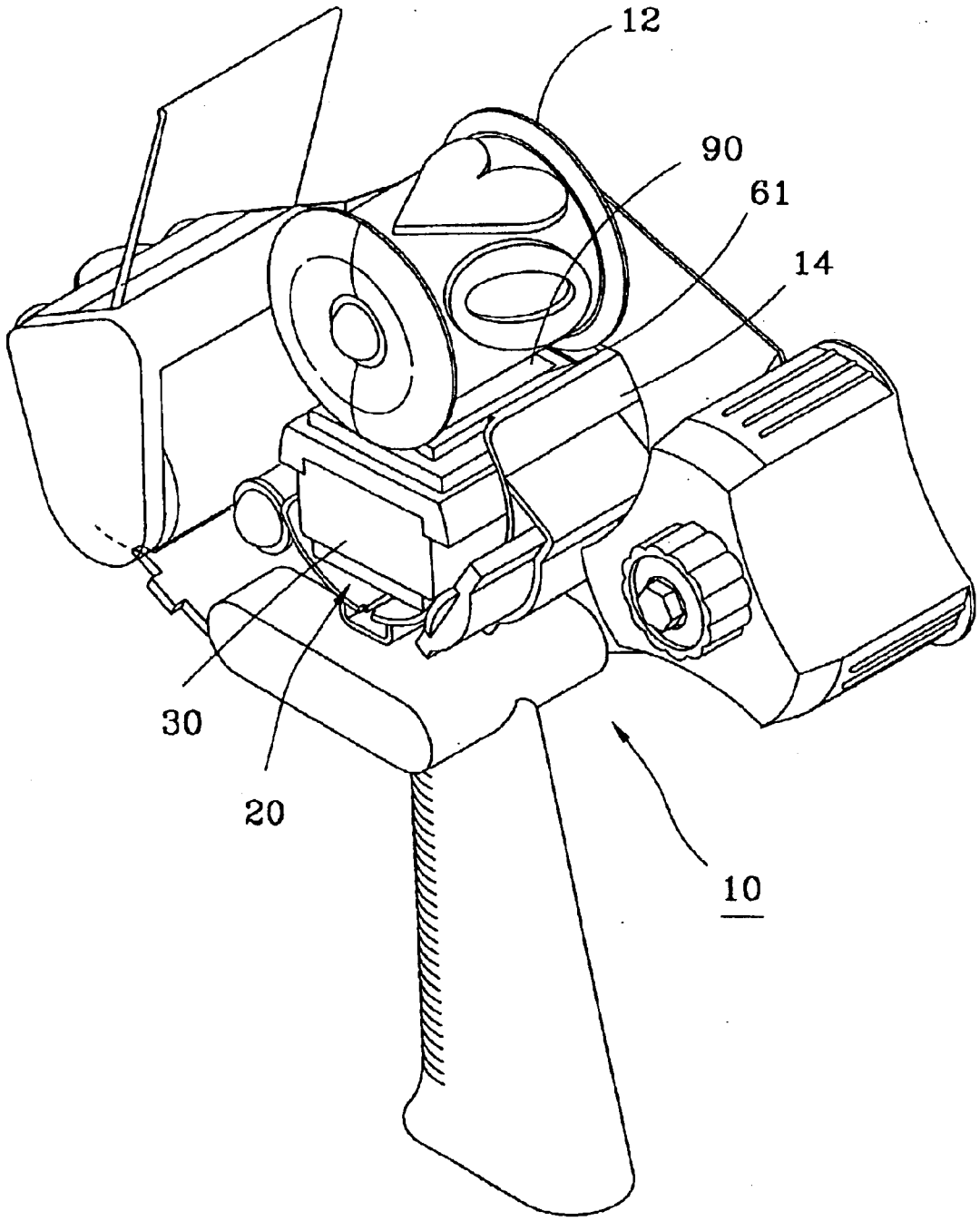
FIG. 3 is an applied view of the present invention, showing the ink supplying device installed in a tape dispenser.

Referring to FIG. 3, when in use, the ink supplying device 20 is installed in a tape dispenser 10 (the structure and operation manner of the tape dispenser 10 are similar to U.S.

Pat. No. 5,947,025). Before operating the tape dispenser 10, ink is dripped onto the fabric ink applying layer 80 through the opening 61 of the housing 30, enabling dripped ink to permeate the ink soaking layer 70 and to be detained in the ink soaking layer 70. The tape dispenser 10 comprises a printing wheel 12, and a cup-like holder 14. The ink supplying device 20 is detachably mounted in the cup-like holder 14 below the printing wheel 12. After installation of the ink supplying device 20 in the cup-like holder 14, the cup-like holder 14 is forced upwards by a torsional spring (not shown), thereby causing the fabric ink applying layer 80 maintained in close contact with the printing surface of the printing wheel 12. When dispensing the tape, the printing wheel 12 is rotated by the tape being dispensed over the fabric ink applying layer 80 and the underside of the tape being dispensed, and therefore ink is continuously applied to the printing surface of the printing wheel 12 when the printing wheel 12 continuously printing a design on the underside of the tape being dispensed.

The ink supplying device 20 further comprises a cover 90 adapted to close the opening 61 of the housing 30. When not in use, the cover 90 is closed on the housing 30 to keep ink from changing into vapor.

As indicated above, the ink supplying device 20 uses the absorptive non-woven fabrics of ink soaking layer 70 to retain ink in the saturated status. The porous structure of the absorptive non-woven fabrics (felt) of ink soaking layer 70 enables the ink soaking layer 70 to be filled with ink completely and, keeps ink from changing into vapor. Therefore, the user needs not to frequently fill ink in the ink supplying device, and much ink cost is saved. Further, the fabric ink applying layer 80 slows down ink drying speed, and can be gently maintained in close contact with the printing surface of the printing wheel 12, enabling ink to be evenly applied to the printing surface of the printing wheel 12 to achieve a high quality printing effect.

What the invention claimed is:

1. An ink supplying device used in a tape dispenser to supply ink to the printing surface of a printing wheel in said tape dispenser for printing a design on a tape being dispensed by said tape dispenser, the ink supplying device comprising:

a housing detachably mounted in said tape dispenser for receiving ink therein;

a porous ink soaking layer mounted inside said housing and adapted to soak the ink;

a fabric ink applying layer covered on said porous ink soaking layer to be contacted with the printing surface of the printing wheel of said tape dispenser for applying the ink from said porous ink soaking layer to said printing surface; and wherein said housing is a box-like hollow member having a top opening in a top side thereof, and a round arch-like inner shell adapted to support said porous ink soaking layer and said fabric ink applying layer inside said housing and to keep a part of said fabric ink applying layer exposed to the outside of said housing through said opening.

2. The ink supplying device as claimed in claim 1, wherein said housing comprises:

a main body, said main body formed of said round arch-like inner shell and a hollow rectangular outer shell surrounding said round arch-like inner shell and defining said top opening, said hollow rectangular outer shell being shaped like a rectangular box having a top open side and a bottom open side, said round arch-like inner shell having two opposite sidewalls equally spaced from two opposite lateral sides of said hollow rectangular outer shell and defining an inside chamber;

a bottom member sealed to a bottom side of said main body, said bottom member having two upright clamping strips inserted into said inside chamber to clamp said porous ink soaking layer and said fabric ink applying layer on two opposite sidewalls of said main body and to hold said fabric ink applying layer on said porous ink soaking layer over said round arch-like inner shell; and a stepped hollow top member sealed to the top side of said main body around said top opening to hold down said fabric ink applying layer and said porous ink soaking layer on said round arch-like inner shell.

3. The ink supplying device as claimed in claim 1, further comprising a cover covered on the top opening of the housing.

4. The ink supplying device as claimed in claim 1, wherein said porous ink soaking layer is made of non-woven fabrics.

* * * * *